US005244337A

United States Patent [19]

Stenger

[11] Patent Number: 5,244,337

[45] Date of Patent: Sep. 14, 1993

[54] MOBILE SHOVEL EXCAVATOR

[75] Inventor: Reinhard Stenger, Stuttgart, Fed. Rep. of Germany

[73] Assignee: Dr. Ing. h.c.F. Porsche AG, Fed. Rep. of Germany

[21] Appl. No.: 947,469

[22] Filed: Sep. 21, 1992

Related U.S. Application Data

[62] Division of Ser. No. 643,939, Jan. 22, 1991, abandoned.

[30] Foreign Application Priority Data

Feb. 5, 1990 [DE] Fed. Rep. of Germany .... 4003325.2

[51] Int. Cl.[5] ..... E02F 3/32; E02F 3/38; E02F 9/08; E02F 9/16

[52] U.S. Cl. ..... 414/687; 414/694

[58] Field of Search ..... 414/680, 686, 687, 685, 414/690, 694, 695, 695.5, 695.6, 695.7, 695.8, 718

[56] References Cited

U.S. PATENT DOCUMENTS

| | | | |
|---|---|---|---|
| 3,430,503 | 3/1969 | McLaughlin | 414/694 X |
| 3,669,286 | 6/1972 | Gauchet | 414/694 |
| 3,717,269 | 2/1973 | Schaeff | 414/694 |
| 4,378,193 | 3/1983 | Schaeff | 414/687 X |
| 4,571,147 | 2/1986 | Schaeff | 414/694 |
| 4,728,251 | 3/1988 | Takashima et al. | 414/694 |

FOREIGN PATENT DOCUMENTS

| | | | |
|---|---|---|---|
| 62-1932 | 1/1987 | Japan | 414/694 |
| 2184419 | 6/1987 | United Kingdom | 414/694 |

*Primary Examiner*—Michael S. Huppert
*Assistant Examiner*—James T. Eller, Jr.
*Attorney, Agent, or Firm*—Evenson, McKeown, Edwards & Lenahan

[57] ABSTRACT

In the case of an excavator, particularly a shovel excavator, the superstructure is held on an undercarriage so that it can be swivelled around a first vertical axis. A jib is held on the superstructure by way of a boom swivelling block which receives the jib in a supporting manner so that it can be swivelled around a second vertical axis of rotation. A swivel device is connected with the boom swivel block and comprises a hydraulic cylinder which is connected with the swivel block by way of a guide rod. The boom swivel block with the jib can be rotated by way of a driven crank mechanism from a forward working end position extending diagonally to the longitudinal center axis of the excavator, about the second vertical axis of rotation, into a transport position which is swivelled back with respect to the driving direction. In this transport position, the jib is arranged in parallel with respect to the longitudinal center axis and laterally of the superstructure, permitting a driving of the excavator in road traffic at a relatively high speed.

6 Claims, 3 Drawing Sheets

MOBILE SHOVEL EXCAVATOR

This is a divisional of application Ser. No. 07/643,939, filed Jan. 22, 1991, now abandoned.

BACKGROUND AND SUMMARY OF THE INVENTION

The invention relates to an excavator, particularly a shovel excavator arrangement comprising:

a superstructure which can be swivelled on an undercarriage about a first vertical axis, a boom swivel block pivotally supported at the superstructure so that it can be swivelled about a second vertical axis, a jib held at the boom swivel block, and a swivelling device connecting the boom swivel block and superstructure, said swivelling device comprising a hydraulic cylinder connected with the swivel block by means of a guide rod.

From the German Patent Document DE-A 27 57 968, a mobile shovel excavator is known which has a boom swivel block which can be swivelled by way of a hydraulic cylinder by approximately 90° from a position in a transverse plane of the vehicle to a position in a longitudinal plane of the vehicle when the revolving superstructure is aligned in the driving direction. The jib, which is pivotally connected to the boom swivel block and has the shovel, can be swivelled on the swivel block by way of a torque motor into a position alongside the revolving superstructure. In the case of this pivotal connection of the boom swivel block, additional devices are required, such as the torque motor, in order to swivel the jib into a transport position.

From the German Patent Document DE-A 34 25 838, another shovel excavator is known which has a swivel device that is connected with the boom swivel block and comprises a hydraulic cylinder connected with the swivel block by means of a guide rod. Because of the construction of the swivel device, the jib of this shovel excavator cannot be placed in a transport position alongside the revolving superstructure so that, as a result of the poor visibility, a road operation at a relatively high speed does not seem possible.

It is an object of the invention to provide a shovel excavator whose jib, by way of a structurally simple swivel device, ensures a relatively large swivel path and permits a driving in road traffic with good visibility at a relatively high speed.

According to the invention, this object is achieved by providing an arrangement wherein the boom swivel block with the jib can be rotated by means of a driven crank mechanism from a forward working end position extending diagonally with respect to the longitudinal center axis of the excavator superstructure about the second vertical axis of rotation, into a swivelled-back transport position with respect to the driving direction in which the jib is arranged parallel to the longitudinal center axis and laterally of the superstructure.

Principal advantages achieved by the invention are that the jib can be displaced from its forward working position to a swivelled-back rearward transport position by means of a swivel device constructed as a crank mechanism, in which case the jib is to be arranged alongside the revolving superstructure and approximately in parallel to the longitudinal center axis of the excavator, and thus the prerequisite exists for a fast driving on the road because the visibility is improved.

The crank mechanism for the boom, which consists essentially of an angle lever and the connecting control rod, has a small size so that only little space is required for its housing. The parts of the crank mechanism, because of their kinematic points, also require only little clearance for their swivel movements.

The crank mechanism is designed in such a manner that in the transport position, that is when the jib is disposed alongside the revolving superstructure, there is a low torque, and the forces to be supported are relatively low because significant loads no longer occur in this position. In the working positions, for example, in an intermediate working position when the jib is swivelled out transversely with respect to the driving direction (FIG. 3), and in a forward working end position (FIG. 1), approximately the same torque is reached. A higher torque exists between these working positions because of the changing lever lengths of the crank mechanism, but the forces to be supported in the axes of rotation remain essentially equally large in all working positions.

Other objects, advantages and novel features of the present invention will become apparent from the following detailed description of the invention when considered in conjunction with the accompanying drawings.

DETAILED DESCRIPTION OF THE DRAWINGS

Figure 1:
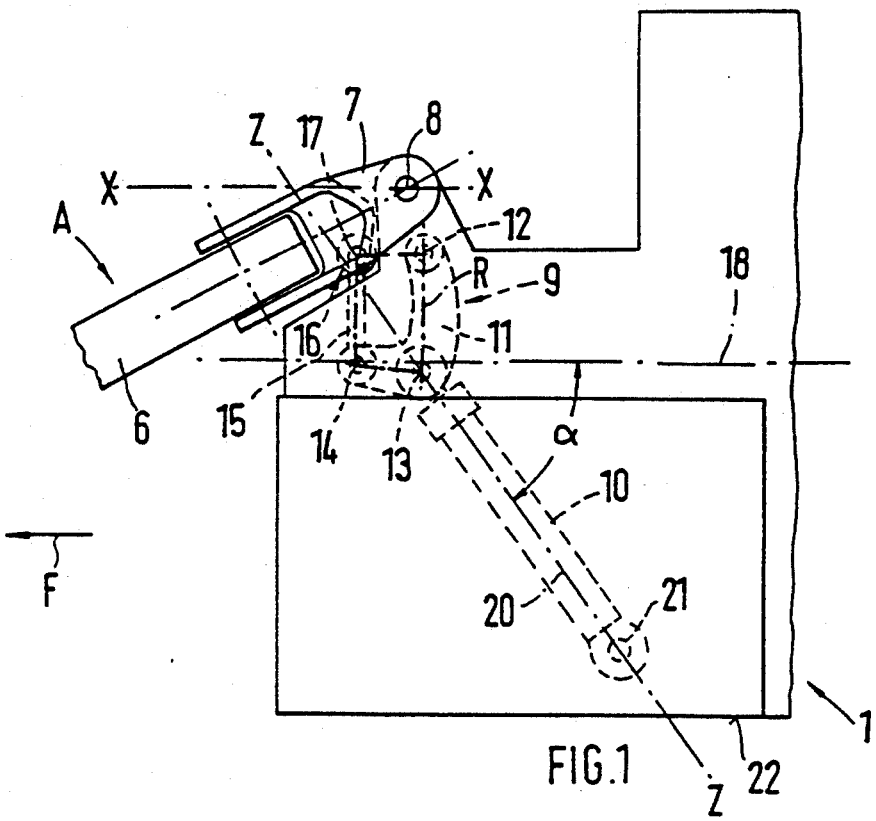
FIG. 1 is a partial schematic top view of an excavator having a swivel device consisting of a crank mechanism, the jib being in a forward working end position, constructed according to a preferred embodiment of the invention.

A shovel excavator 1 comprises essentially a lower carriage 2 having a chassis and wheels 3. A revolving superstructure 4 is provided which is rotatable by way of a live ring about a first vertical axis of rotation 1A with respect to the lower carriage 2. A driver's cab 5 is arranged in revolving superstructure 4. A jib 6, as a monoblock boom, is connected with the revolving superstructure 4 by way of a boom swivel block 7 so as to be swivelable around a second vertical axis of rotation 8.

The boom swivel block 7 is connected with a crank mechanism 9 which is driven by a hydraulic cylinder 10. The crank mechanism 9 essentially comprises an angle lever 11 which can be swivelled about a third vertical axis of rotation 12 fixed on the body. The angle lever 11 has two hinge points 13 and 14. The hydraulic cylinder 10 by means of its piston rod is applied to one hinge point 13, and a connecting guide rod 15 being disposed in the additional hinge point 14. The connecting guide rod 15, in turn, is connected with the boom swivel block 7 in a hinged manner in a bearing 16 with a vertical axis of rotation 17.

Figure 2:
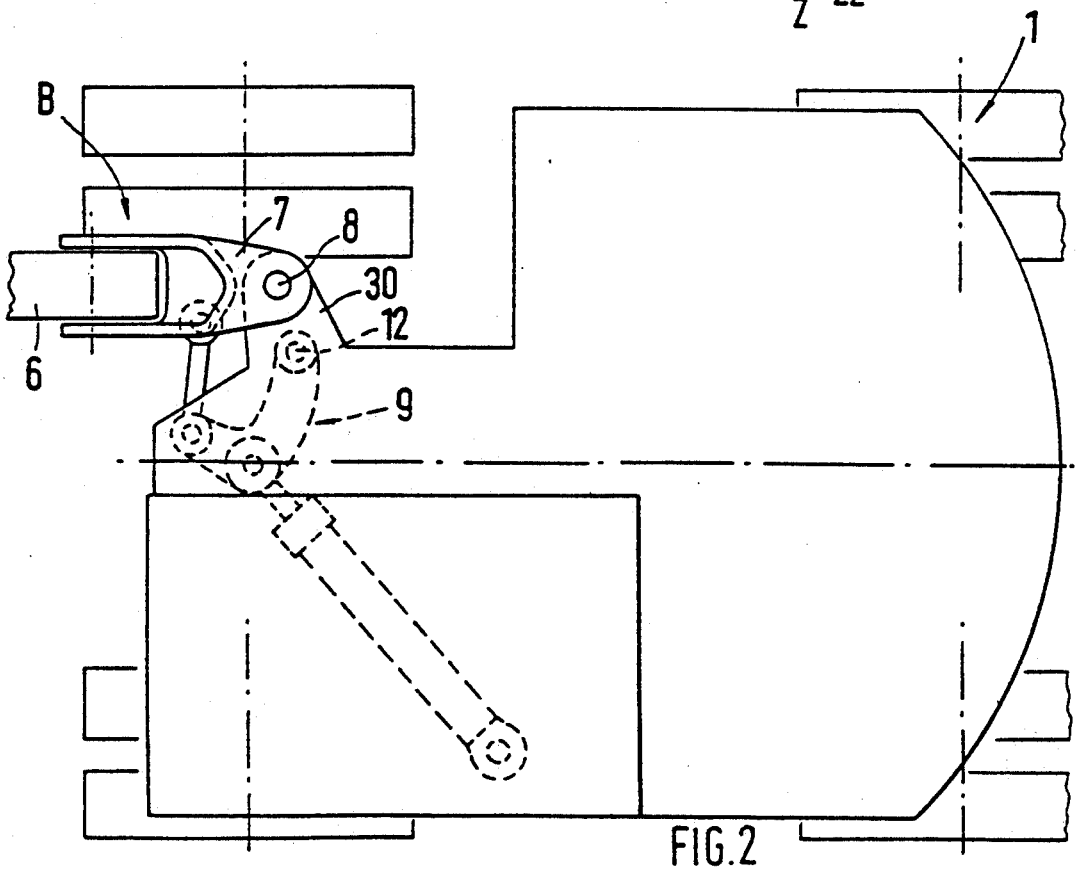
FIG. 2 is a partial schematic top view of the excavator of FIG. 1, shown in an intermediate working position with the jib arranged in the longitudinal direction of the vehicle.
Figure 3:
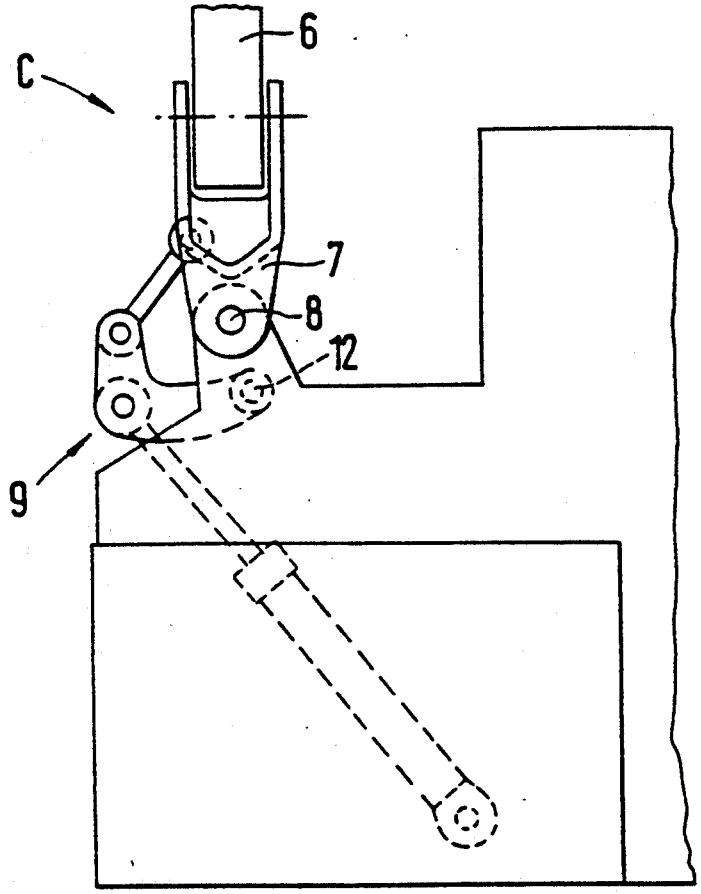
FIG. 3 is a partial schematic top view of the excavator of FIG. 1, shown in an intermediate working position with the jib arranged in the transverse direction of the vehicle.
Figure 4:
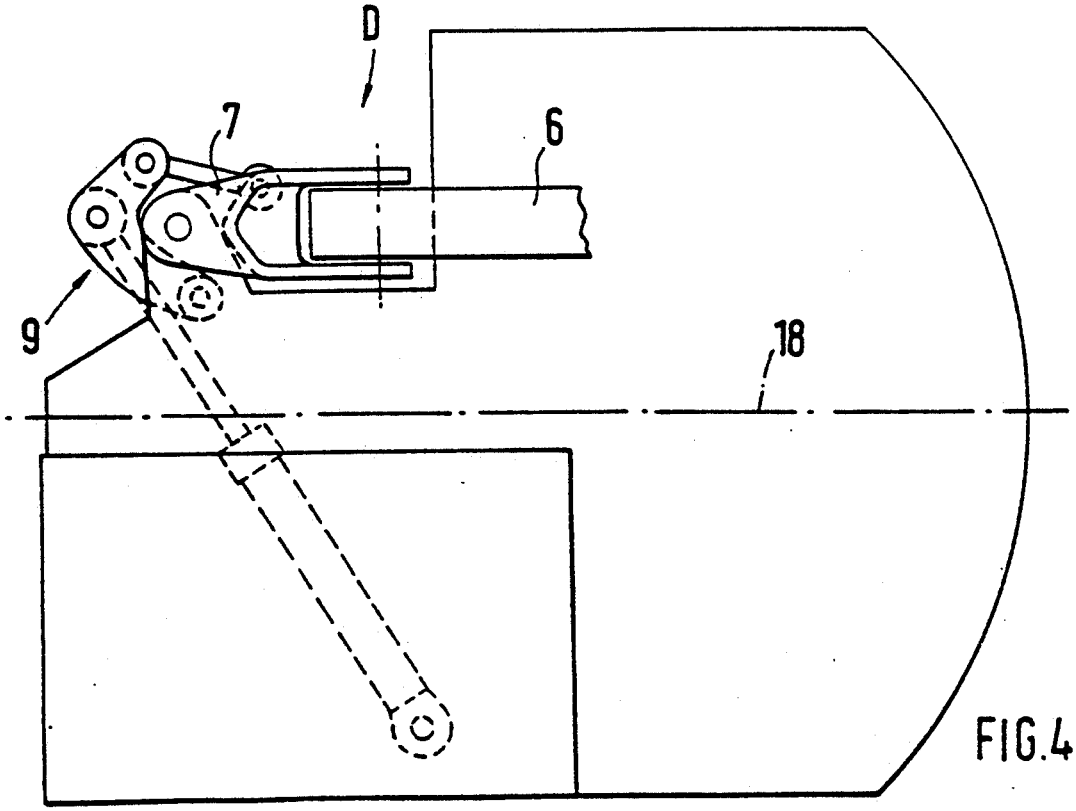
FIG. 4 is a partial schematic top view of the excavator of FIG. 1, shown in a rear transport position of the jib in a swivelled-back deposited position.

The boom swivel block 7 with the jib 6 can be swivelled from a forward working end position A (FIG. 1), by way of intermediate working positions, such as B and C (FIGS. 2 and 3), into a transport position D (FIG. 4). In the forward working position A, the boom swivel block 7 with the jib 6 is disposed approximately at an angle of 30° with respect to a plane X—X extending in parallel to the longitudinal center axis 18 through the second axis of rotation 8. Starting from this working position A, the jib 6 can be swivelled to the rearward working position C about the axis of rotation 8 in which the jib 6 is aligned transversely to the revolving superstructure 4.

By means of a further swivelling of the jib 6 against the driving direction F, the jib 6 takes up a transport position D (FIG. 4). In this position D, the jib 6 together with the shovel is disposed alongside the revolving superstructure 4 and in parallel to the longitudinal center axis 18 of the vehicle 1.

In order to achieve this desired swivel motion at an angle of approximately 210° or more without any additional swivel motors, the crank mechanism 9, in the forward working end position A, must take up a position as shown in FIG. 1. The hinge points 13 and 14 of the angle lever 11 and the linking point or the axis of rotation 17 of the connecting guide rod 15 on the boom swivel block 7 as well as the vertical axis of rotation 12 of the angle lever 11 fixed on the body form the corner points of an imaginary rectangle R, which is illustrated in FIG. 1 by dash-dotted lines.

The hydraulic cylinder 10 is applied with respect to the crank mechanism 9 in such a manner that the longitudinal axis 20 of the hydraulic cylinder 10 is disposed in a vertical plane Z—Z in which the hinge point 13 of the crank mechanism 9 and, adjacent to the plane, the axis of rotation 17 of the connecting guide rod 15 is arranged.

With respect to the driving direction F—the hydraulic cylinder 10 is arranged in a position that is directed diagonally toward the front and inside and is disposed at an acute angle $\alpha$ of approximately 45° with respect to the longitudinal center axis 18, the linking point 21 on the body side being situated close to the outer wall 22 of the revolving superstructure 4.

Figure 5:
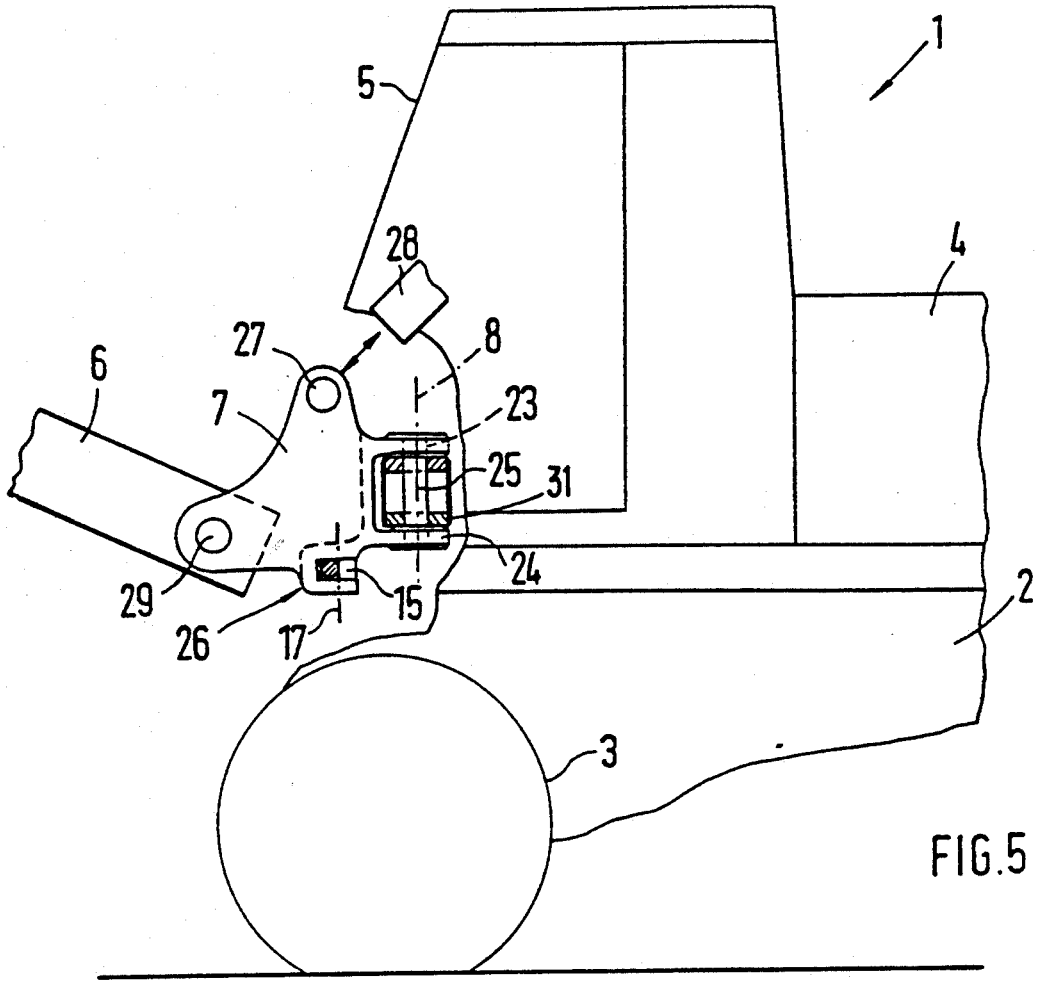
FIG. 5 is a partial lateral schematic view of the excavator of FIGS. 1–4, showing the boom swivel block.

As illustrated in detail in FIG. 5, the boom swivel block 7 receives a horn 31 of the revolving superstructure 4 between the legs 23 and 24 and is fastened by means of a pin 25 which forms the second axis of rotation 8. In another receiving device 26, the connecting guide rod 15 is supported and can be rotated around the vertical axis 17. A swivel cylinder 28 for the vertical adjustment of the jib 6 is applied in a lug 27 of the boom swivel block 7. The other lug 29 is used for receiving the jib 6.

Figure 6:
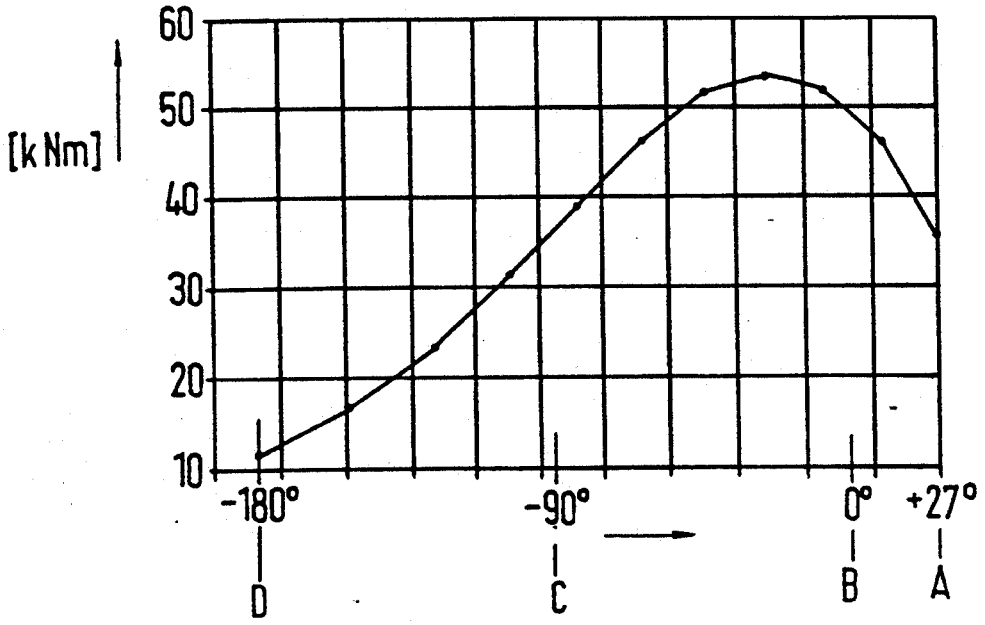
FIG. 6 is a diagram of the course of the torque of the swivel device as a function of the swivel angle of the jib of the excavator of FIGS. 1–5.

By means of the diagram according to FIG. 6, it is illustrated that the torques about the vertical axis 8 of the boom swivel block 7 in position A and C, that is, in the forward working end position A and in the rearward working end position C, are approximately equally large, and an increase of the torque in the intermediate working position, takes place as a result of the kinematics of the crank mechanism. The bearing forces to be supported are approximately equally large in the working positions because of the construction of the crank mechanism.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. A shovel excavator, comprising an undercarriage, a superstructure mounted on the undercarriage and swivelable on the undercarriage about a first vertical axis, a boom swivel block pivotally mounted on the superstructure and swivelable about a second vertical axis, a jib pivotally mounted on the boom swivel block and arranged to be pivoted about a horizontal axis, and a drivable crank mechanism connected between the boom swivel block and the superstructure for swiveling the jib between working positions and a transport position, said drivable crank mechanism comprising a guide rod having a first end pivotally connected to said boom swivel block at a first pivotal connection point, an angle lever having a first end pivotally connected to a second end of said guide rod at a second pivotal connection point, said angle lever having a second end pivotally connected to the superstructure at a third pivotal connection point, and a hydraulic cylinder having a first end pivotally connected to said angle lever at a fourth pivotal connection point located on said angle lever intermediate said second and third pivotal connection points, and a second end pivotally connected to the superstructure, wherein said first, second, third and fourth pivotal connection points define corner points of an imaginary approximately rectangular shape with the first pivotal connection point directly adjacent to a perpendicular plane extending through a longitudinal axis of the hydraulic cylinder such that the jib can be rotated from a forward working end position extending obliquely to a longitudinal center axis of the excavator about the second vertical axis of rotation into the transport position which, with respect to a driving direction of the excavator, is swivelled backwardly so that the jib is arranged parallel to the longitudinal center axis and laterally of the superstructure.

2. The shovel excavator according to claim 1, wherein the jib can be swivelled from the transport position to the working positions over a range in excess of 200°.

3. The shovel excavator according to claim 1, wherein the boom swivel block in the forward working end position is arranged at an acute angle of approximately 30° with respect to a vertical plane extending in parallel to the longitudinal center axis and through the second vertical axis of rotation, and in the transport position, the boom swivel block takes up a rear end position that is swivelled by greater than 200° with respect to the forward working end position.

4. The shovel excavator according to claim 1, wherein the hydraulic cylinder has a diagonal position with respect to the driving direction directed diagonally frontwardly and inwardly of outside walls of the superstructure at an acute angle of approximately 45° with respect to the longitudinal center axis, and the hydraulic cylinder is linked to the superstructure at a point situated close to an outer wall of the superstructure.

5. The shovel excavator according to claim 1, wherein bearings are provided on a side of the superstructure for the swivelling device, and wherein supporting forces on said bearings in individual swivelling positions as well as in intermediate swivelling positions thereof are approximately equally large, and wherein torques about the second vertical axis are approximately equally large in the forward end working position and a rearward end working position.

6. The shovel excavator according to claim 1, wherein the superstructure has a horn divided into two legs for holding the boom swivel block, and a pin is arranged in the two legs to form the second vertical axis of rotation, and an additional receiving device is provided on the boom swivel block for the fastening of the guide rod.

* * * * *